US006431693B2

(12) United States Patent
Eida

(10) Patent No.: US 6,431,693 B2
(45) Date of Patent: Aug. 13, 2002

(54) LIQUID PRESSURE SUPPLY APPARATUS AND LIQUID DISCHARGE RECORDING APPARATUS USING THE SAME

(75) Inventor: Masataka Eida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/797,565

(22) Filed: Mar. 5, 2001

(30) Foreign Application Priority Data

Mar. 8, 2000 (JP) ..... 2000-063644

(51) Int. Cl.[7] ..... B41J 2/175
(52) U.S. Cl. ..... 347/85
(58) Field of Search ..... 347/6, 84, 85, 347/86, 87

(56) References Cited

U.S. PATENT DOCUMENTS

| | | | | | |
|---|---|---|---|---|---|
| 3,720,473 | A | * | 3/1973 | Nakata | 401/40 |
| 4,723,129 | A | | 2/1988 | Endo et al. | 346/1.1 |
| 5,132,711 | A | * | 7/1992 | Shinada et al. | 347/6 |
| 5,280,300 | A | | 1/1994 | Fong et al. | 346/1.1 |
| 5,734,401 | A | * | 3/1998 | Clark et al. | 347/86 |
| 5,751,300 | A | | 5/1998 | Cowger et al. | 347/6 |
| 5,812,156 | A | | 9/1998 | Bullock et al. | 347/19 |
| 5,975,689 | A | | 11/1999 | Pawlowski, Jr. | 347/86 |

FOREIGN PATENT DOCUMENTS

| | | |
|---|---|---|
| EP | 785072 | 7/1997 |
| JP | 57-26262 | 2/1982 |
| JP | 5-8401 | 1/1993 |
| JP | 5-270001 | 10/1993 |
| JP | 5-305713 | 11/1993 |
| JP | 7-243542 | 9/1995 |
| JP | 7-251507 | 10/1995 |
| JP | 9-89146 | 3/1997 |
| JP | 9-254413 | 9/1997 |
| JP | 10-217509 | 8/1998 |
| JP | 10-217510 | 8/1998 |
| JP | 11-63275 | 3/1999 |

* cited by examiner

*Primary Examiner*—Anh T. N. Vo
(74) *Attorney, Agent, or Firm*—Fitzpatrick, Cella, Harper & Scinto

(57) ABSTRACT

There is disclosed a liquid supply apparatus which is disposed in an ink outlet of a flexible ink storage bag, having no pressure for supplying an ink, or disposed midway in an ink supply path, for supplying the ink to an ink jet head, and which is small in size, little in power consumption and simple in mechanism. A liquid pressurizing supply apparatus is driven in response to an alternating or pulse electric signal, and comprises a high-permeability driving shaft, a spring for urging the driving shaft in one direction, a bobbin case in which the driving shaft is disposed in a cylindrical chamber, a winding coil wound around an outer peripheral surface of the bobbin case, a pair of high-permeability case members in which the bobbin case with the winding coil wound therearound is contained, and a containing recess portion is formed by a sheet metal drawing process, inlet and outlet joints connected to the cylindrical chamber of the bobbin case, and a ball check valve for preventing ink back-flow.

15 Claims, 8 Drawing Sheets

LIQUID PRESSURE SUPPLY APPARATUS AND LIQUID DISCHARGE RECORDING APPARATUS USING THE SAME

BACKGROUND OF THE INVENTION

1. Field of the Invention

The present invention relates to an ink jet recording apparatus for use in recording and printing a character and image, particularly to an ink jet recording apparatus for use in a copying machine, a facsimile machine, an image output machine of a computer, or a printer.

Above all, the present invention relates to an ink supply apparatus to an ink jet head for printing/recording an image, and an ink supply mechanism provided with an ink jet head cleaning and recovering function for pressurizing and supplying an ink during cleaning and recovering of the ink jet head.

2. Related Background Art

A principle of an ink jet print system is disclosed in U.S. Pat. No. 4,723,129. As a printer, an on-demand system product has broadly spread since around 1985.

In a conventional method of supplying ink to an ink jet head of an ink jet printer, a negative pressure system has generally been used. In many cases, the ink jet head consumes ink with which a sponge or another porous material is impregnated. This form is described, for example, in Japanese Patent Application Laid-Open No. 5-270001.

In this method of supplying the ink to the ink jet head, as the ink is consumed, a negative pressure of the sponge increases, and a discharge state of an ink droplet from the ink jet head fluctuates.

In recent years, particularly to record a photographic image, a size of the ink jet droplet has been of the order of 4 to 8 pl (1 pl=$1\times10^{-12}$ liters), and an influence of the negative pressure has increased.

Moreover, a printing speed of the ink jet printer has increased because of rapid enhancement of a processing speed of an arithmetic operation element inside a computer and printer, and ink consumption has increased. Therefore, an ink supply amount from the sponge is insufficient, the negative pressure temporarily rapidly increases, and image turbulence occurs in accordance with a printing pattern. In order to solve a negative pressure fluctuation, instead of holding the ink in the sponge, the ink is held and supplied in a liquid state so that this problem can be solved. For this, a technique is disclosed, for example, in Japanese Patent Application Laid-Open No. 5-305713.

However, when printing is continuously performed with the ink jet head, dust and foreign particle stick to a surface of the ink jet head as an ink droplet discharge surface, or a slight bubble is generated inside the ink jet head. In this case, it becomes impossible to effectively discharge ink jet droplets via about 300 to 8000 ink jet discharge holes without any defect. Therefore, it is necessary to subject the ink jet head to cleaning and recovery processing after a given number of sheets are printed, or when an image defect is detected by some means. As disclosed in Japanese Patent Application Laid-Open No. 5-008401, this cleaning is performed by scraping dust off the surface of the head with a rubber plate, or by covering the surface with a cap to perform suction recovery. However, when the surface of the ink jet head held in a negative pressure state is wiped with a wiper or another plate, the rubber and foreign particle sticking to the head surface enters the ink jet discharge holes, and a problem occurs that the ink jet discharge holes are closed.

To solve the problem, a method of simultaneously performing suction and surface wiping is necessary.

However, when an apparatus is provided with both a suction mechanism and a surface wiping mechanism, the apparatus is enlarged in size, which is economically disadvantageous in respect of an apparatus manufacturing cost.

Generally considering the aforementioned conventional art problem, an ink supply apparatus and ink supply method in which a constant negative pressure is held during printing in the ink jet head, and cleaning and recovering of the ink jet head can be performed by supplying the ink in a pressurized state and discharging the ink via the ink jet head, and which is simple and small-sized and can be stable in operation have not been technically established yet.

This method is solved to some extent by a method described in Japanese Patent Application Laid-Open Nos. 10-217509 and 10-217510. This technique includes a step of supplying the ink to the ink jet head from an ink tank via ink pressurizing supply means. For a detail constitution, as shown in FIGS. 9A and 9B, ink pressurizing supply means 201 is driven by a part of a driving mechanism 804 disposed on a printer main body (not shown) side. When an ink tank 200 is mounted as shown by a dashed line of FIG. 9A, a diaphragm 804*a* cam-driven by the driving mechanism 804 is pushed into the ink tank 200 to pressurize an ink storage chamber. Thereby, the ink in the ink storage chamber is supplied under pressure to the ink jet head (not shown) on the printer main body side via a connection port 110.

A vale which opens to atmosphere at a constant or lower negative pressure is disposed inside the ink tank 200 in such a manner that the ink is supplied.

In this method, however, in order to supply the ink from the ink tank, a combination of two mechanisms is necessary: a mechanical operation mechanism 803, disposed inside the ink tank 200, for applying an ink supplying pressure; and the large-sized mechanism 804 disposed on the printer main body side. There is a problem that a complicated apparatus mechanism is necessary for pressurizing and supplying the ink.

As described above, the conventional example has a problem that the apparatus is enlarged in size and complicated in constitution, but in order to supply the pressurized ink to the ink jet head, some ink supply apparatus needs to be added.

Then, the present inventor has studied manufacturing of a small-sized ink supply apparatus, disposed in an outlet of a flexible ink storage baglike member, or midway in an ink supply path, for supplying the ink to the ink jet head, but have found that it is very difficult to manufacture the small-sized ink supply apparatus.

The reason is as follows. In order to print a colored photographic image, the ink jet printer requires at least four colors (black, yellow, magenta, cyan) of ink and/or light colors (light yellow, light magenta, light cyan) of ink or a flesh color of ink. When the ink tank for storing these types of ink, mechanism for pressurizing and supplying these types of ink, and ink jet head as a mechanism for receiving supply of these types of ink are mounted, the ink jet printer is necessarily enlarged, and power consumption also increases. Therefore, the size of the small-sized ink supply apparatus for pressurizing the ink needs to be small. A volumetric size of the apparatus is preferably 8 $cm^3$ or less, power consumption needs to be one watt or less, and further an independent control operation is necessary. These problems need to be solved.

SUMMARY OF THE INVENTION

An object of the present invention is to solve the aforementioned problem, to provide a liquid pressurizing supply apparatus which is disposed in an outlet of a flexible ink storage bag-like member or midway in an ink supply path so that ink can be supplied to an ink jet head, and which is small in size, little in power consumption and simple in mechanism, and to provide a liquid discharge recording apparatus using the liquid pressurizing supply apparatus.

In order to achieve the aforementioned object, as a result of intensive studies, the present inventor et al. have found that the ink can be pressurized and supplied by manufacturing a small-sized electromagnetic actuator, and disposing a one-way valve on the actuator. The small-sized electromagnetic actuator can operate with an operation power of about one watt or less, but a large problem has further occurred.

That is, when the actuator is small-sized with power consumption of about one watt or less, a driving distance of the actuator is about 0.8 mm or less, and an amount of ink able to be supplied with one operation is small (50 $\mu$liter). Therefore, if the one-way valve is not satisfactorily shielded, ink flows in a reverse direction against pressure, and a problem is that the pressure does not rise. Therefore, a method of satisfactorily pressurizing and supplying the ink even with a small driving distance and insufficient supply ability has been reviewed in more detail. As a result, the following method of solving the problem has been found.

The ink supply ability is insufficient, and the ink cannot be pressurized, because an ink reverse flow amount is large. It has been found that the amount may excessively be reduced, or set to "0". As a result of checking a shielded portion of the one-way valve inside the small-sized actuator in detail, a processing scratch with a depth of 10 $\mu$m or less is found, and the ink flows in the reverse direction through a gap of the scratch. To solve the problem, it has been proposed to mirror-surface abrade the corresponding surface, but it is economically impossible to use such method in manufacturing the actuator. Then, as a result of further intensive study, the problem has been solved by satisfactorily smoothening the surface of the shielded portion of the one-way valve. Moreover, an economical problem that the number of members and the number of assembly steps increase has been solved by appropriately forming components integrally with one another.

Furthermore, to enhance the ink supply ability, the actuator is provided with one check valve or a plurality of check valves. Additionally, the supply ability has further been enhanced by disposing an ink flow-in taper inside the actuator.

When the liquid pressurizing supply apparatus using the small-sized electromagnetic actuator manufactured as described above is operated in response to an ink request signal from the ink jet head, the ink can be pressurized and supplied to the ink jet head, and the aforementioned problem can be solved.

The liquid pressurizing supply apparatus of the present invention achieved to solve the various problems is constituted as follows.

That is, according to the present invention, there is provided a liquid pressurizing supply apparatus driven in response to an alternating or pulse electric signal, comprising: a high-permeability driving shaft; urging force generation means for urging the driving shaft in one direction; a bobbin case in which the driving shaft is disposed in a cylindrical chamber; a winding coil wound around an outer peripheral surface of the bobbin case; a pair of high-permeability case members in which the bobbin case with the winding coil wound therearound is contained, and a containing recess portion is formed by a sheet metal drawing process; a channel portion connected to the cylindrical chamber of the bobbin case in which the driving shaft is disposed; and at least one back-flow prevention means for preventing back-flow. In this constitution, when the electric signal is applied to the winding coil, an electromagnetic force is generated, and the driving shaft moves against the urging force of the urging force generation means in the cylindrical chamber in the bobbin case. Thereby, a liquid supplied into the chamber is pressurized and supplied via the channel portion. Subsequently, when the supply of the electric signal is stopped, the driving shaft is returned to its original position by the urging force of the urging force generation means. In this case, no back flow occurs because of an action of the back-flow prevention means. Therefore, the liquid can be supplied under pressure to a downstream side from an upstream side of the present apparatus by repeating the aforementioned reciprocating movement of the driving shaft. In this constitution, the small-sized apparatus can be provided at a low manufacturing cost, and can further be driven with power consumption of about one watt or less.

Moreover, in the apparatus, a portion onto which the driving shaft is pressed by the urging force generation means is a molded smooth surface integrally molded with the bobbin case, a portion of the driving shaft bonded to the molded smooth surface is provided with a seal rubber, and the channel portion is preferably shielded by the molded smooth surface and seal rubber. Alternatively, the portion onto which the driving shaft is pressed by the urging force generation means is a coated smooth surface formed on a bottom surface of the containing recess portion of the high-permeability case member, the portion of the driving shaft bonded to the coated smooth surface is provided with the seal rubber, and the channel portion is preferably shielded by the coated smooth surface and seal rubber. In this constitution, in a standby state before driving, the seal rubber of the driving shaft is pressed onto the molded smooth surface or the coated smooth surface, and the channel portion is satisfactorily shielded. Therefore, even when the moving distance is short and the liquid supply amount is small, the liquid can satisfactorily pressurized and supplied.

For the back-flow prevention means, the apparatus is provided with one or both of a ball check valve and a film check valve. With this constitution, the back flow is satisfactorily prevented, and the liquid pressurizing supply ability is enhanced.

In the cylindrical chamber of the bobbin case, an inclined taper portion for enlarging an inner diameter in the vicinity of the portion onto which the driving shaft is pressed by the urging force generation means of the chamber is preferably formed. With this constitution, a liquid flow-in resistance decreases, and the liquid supply ability is further enhanced.

A volume of the apparatus is 8 $cm^3$ or less, a moving distance of the driving shaft is in a range of 0.1 to 0.8 mm, and a power of the electric signal is in a range of 0.2 to 1.5 W.

Moreover, according to the present invention, there is provided a liquid discharge recording apparatus comprising: a liquid discharge head for ejecting a liquid droplet to record an image; liquid residual amount detection means; liquid storage means; a liquid supplying pipe for supplying a liquid of the liquid storage means to the liquid discharge head; one of above mentioned a liquid pressurizing supply apparatuses; and driving control means of the liquid pressurizing supply apparatus. The liquid pressurizing supply apparatus is disposed midway in the liquid supplying pipe or in a liquid guide outlet of the liquid storage means. The driving control means allows the liquid pressurizing supply apparatus to supply the liquid in a pressurized state during cleaning/recovering of the liquid discharge head so that the liquid is ejected via a discharge orifice of the liquid discharge head. In this constitution, during cleaning/recovering of the liquid discharge head, the liquid is ejected via the discharge orifice of the liquid discharge head, while a surface with the discharge orifice formed therein can be wiped with a wiper. Therefore, dust, and the like on the surface with the discharge orifice formed therein are prevented from being pushed into the discharge orifice.

The liquid storage means can be applied in normal pressure, 0-pressure, or negative pressure state of a head pressure of 0 to 1000 mm aq.

The liquid discharge recording apparatus is preferably disposed for each color system.

DETAILED DESCRIPTION OF THE PREFERRED EMBODIMENTS

Embodiments of the present invention will be described hereinafter with reference to the accompanying drawings. Moreover, examples in which the present invention is applied to an ink supply system of an ink jet printer will be described here, but the present invention is not limited to these examples.

First Embodiment

Figure 1:
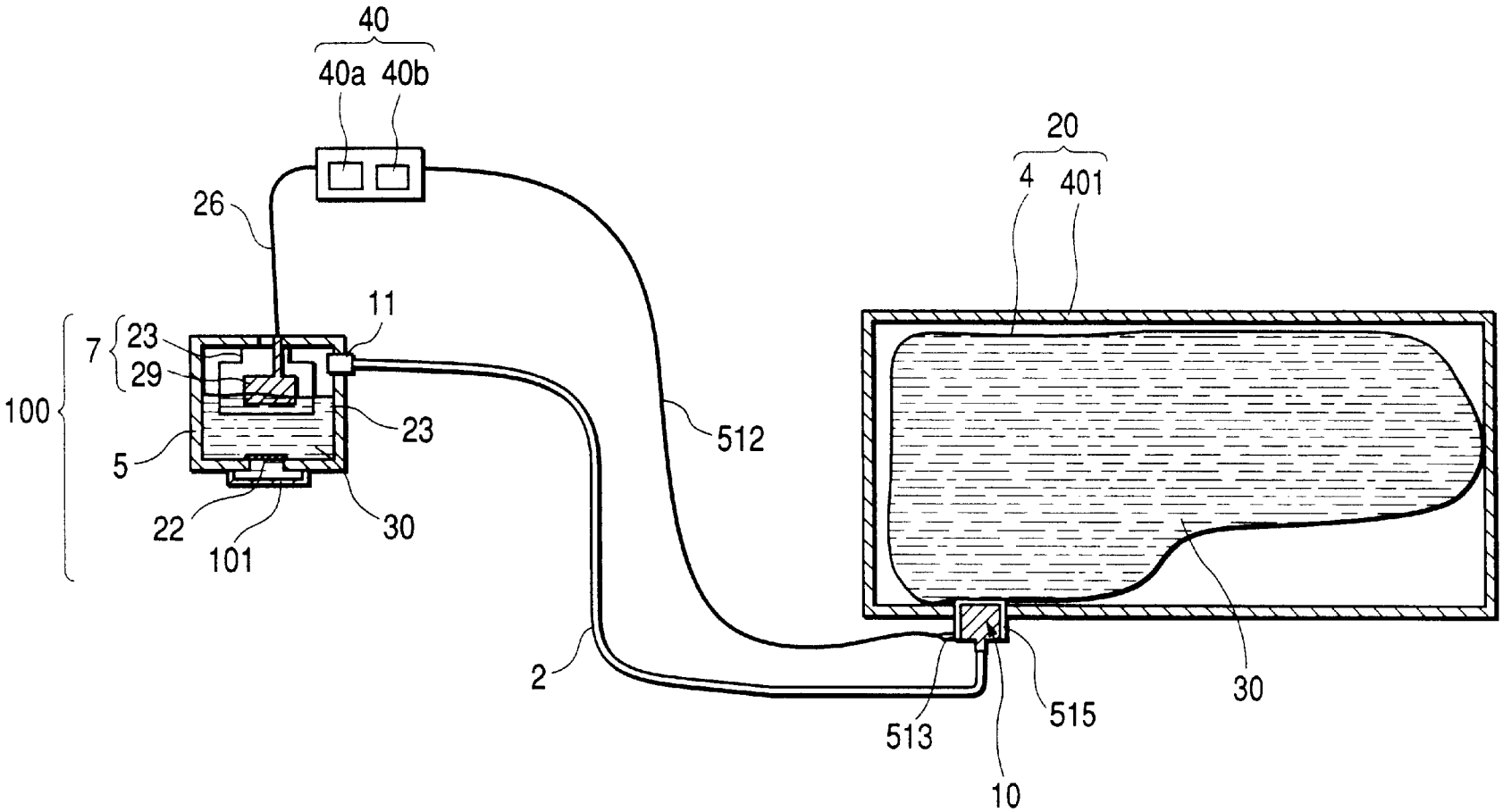
FIG. 1 is a schematic view of an ink supply system of an ink jet printer as one example to which a liquid pressurizing supply apparatus of the present invention is applied.

FIG. 1 is a schematic view of an ink supply system of an ink jet printer as one example to which a liquid pressurizing supply apparatus of the present invention is applied. In FIG. 1, the ink supply system basically includes an ink jet head 100, ink storage means 20 for storing an ink for use in the ink jet head 100, a liquid pressurizing supply apparatus 10 for pressurizing and supplying the stored ink to the ink jet head 100; and driving control means 40 of the liquid pressurizing supply apparatus 10. Furthermore, for the purpose of holding stability of a discharge operation, inside the ink jet head 100, ink residual amount detection means 7 for detecting necessity of ink supply to the ink jet head 100, and the like are disposed.

Disposed in the driving control means 40 are a memory 40*a* for storing a signal from the ink residual amount detection means 7, and an operator/controller 40*b* for receiving a signal from the ink residual amount detection means 7 and memory 40*a* to control an operation of the liquid pressurizing supply apparatus 10. Moreover, the driving control means 40 is electrically connected to the liquid pressurizing supply apparatus 10 (concretely, a winding coil 503 shown in FIG. 2) via an electric wire 512 and lead terminal 513.

The ink storage means 20 is a flexible ink bag 4, but may be a simple container. For a bag-like member, the member is preferably protected by a solid housing 401. Moreover, the ink storage means 20 can prevent ink from leaking, evaporating or flying, or can prevent foreign particles from entering the storage means. Additionally, rise of a negative pressure with ink consumption is preferably as small as possible.

The liquid pressurizing supply apparatus 10 is disposed in a tank joint 515 fixed as an ink outlet of the ink bag 4 to the housing 401, and connected to a pipe 2 for supplying the liquid to the ink jet head 100. The liquid pressurizing supply apparatus 10 may be dispose midway in a path of the liquid supplying pipe 2 for connecting the ink bag 4 to the ink jet head 100.

Figure 2:
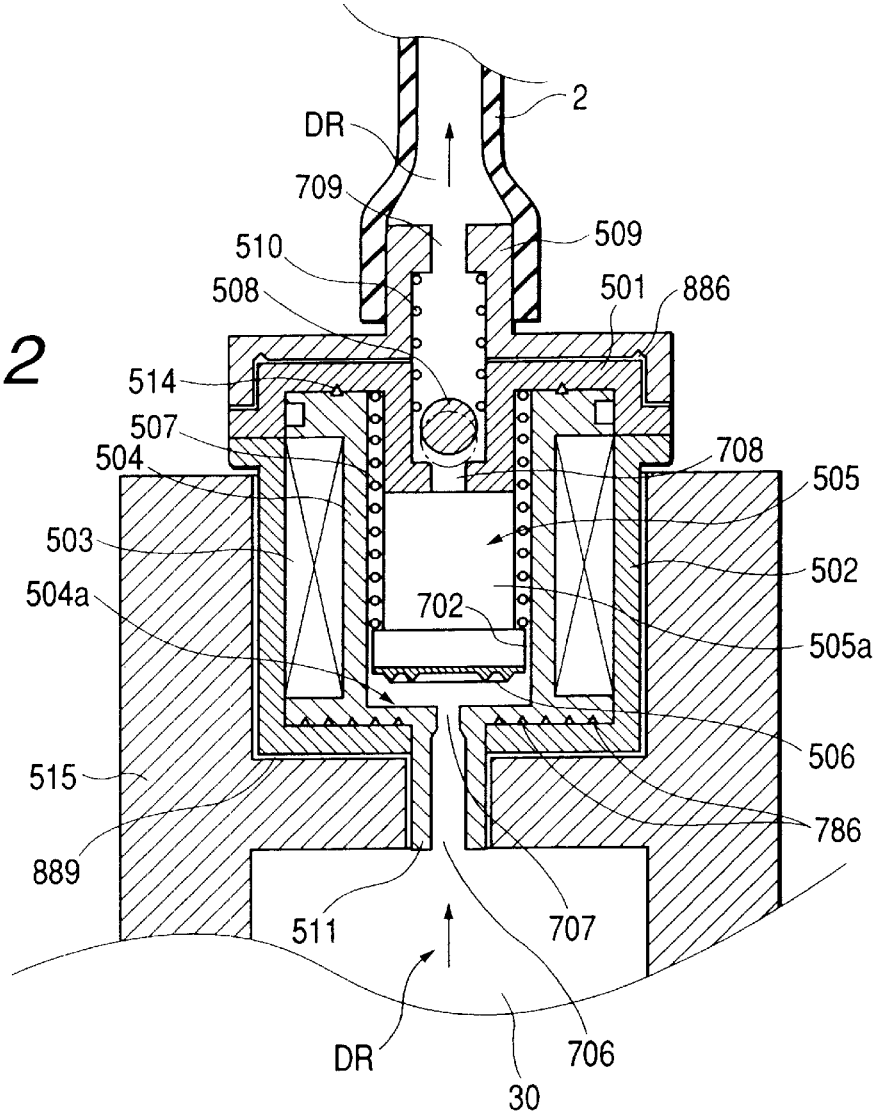
FIG. 2 is a schematic sectional view showing a state in which the liquid pressurizing supply apparatus of a first embodiment of the present invention supplies liquid.

FIG. 2 is a schematic sectional view showing a state in which the liquid pressurizing supply apparatus of a first embodiment of the present invention supplies liquid. In this type of the liquid pressurizing supply apparatus, a bobbin case 504 with the winding coil 503 wound therearound is fixed between upper and lower case members 501 and 502, and the upper and lower case members 501 and 502 also serve as a housing and magnetic flux path of the present apparatus.

A driving shaft 505 for supplying the pressurized liquid is disposed in a through hole in a center of the bobbin case 504, while the shaft is urged by a spring 507. The driving shaft 505 has a flange, the spring 507 abuts on an outer periphery of the driving shaft 505, and a gap 702 is formed between the flange and the bobbin case 504.

In the bobbin case 504, an inlet joint 511 is integrally constituted to form an ink inlet 706 and ink inlet port 707 extending into a chamber in which the driving shaft 505 is disposed. The inlet joint 511 projects from the lower case member 502. The ink storage means 20 and tank joint 515 are bonded to the inlet joint 511 and lower case member 502.

In the chamber in which the driving shaft 505 is disposed, a wall surface portion with the ink inlet port 707 formed therein is a mirror surface portion 504*a*. An end surface of the driving shaft 505 disposed opposite to the mirror surface portion 504*a* is provided with a seal rubber 506, and the seal rubber is pressed onto the mirror surface portion 504*a* of the bobbin case 504 by a force of the spring 507. Since the present apparatus is small-sized with power consumption of about one watt or less, a moving distance of the driving shaft is 0.8 mm or less, and ink supply amount per one operation is as small as several tens of microliters. Therefore, if an ink channel is not satisfactorily shielded during movement of the driving shaft in a direction opposite to an ink supply destination, the ink flows backward under pressure, and no ink can be supplied. Such phenomenon occurs when there is a micro processing scratch with a depth of 10 μm or less in a shielded portion. Therefore, the seal rubber 506 is bonded to the end surface of the driving shaft 505, and further the surface on which the seal rubber 506 abuts is finished as the mirror surface portion 504*a*.

In the upper case member 501, an ink outlet port 708 present in the chamber in which the driving shaft 505 is disposed is formed. Moreover, an outlet joint 509 having an ink outlet 709 is bonded to the upper case member 501. Therefore, a ball check valve 508 is disposed, and a chamber for connecting the ink outlet 709 to the ink outlet port 708 is formed. In this chamber, the ball check valve 508 is urged by a fixed spring 510, and the ink outlet port 708 is closed.

The outlet joint 509 is connected to the ink jet head 100 via the liquid supplying pipe 2.

As described above, according to the constitution shown in FIGS. 1 and 2, the ink residual amount detection means 7 in the ink jet head 100 detects that an ink residual amount is small, and a signal indicating this is supplied to the driving control means 40 via the electric signal conductor 26. As a result, the driving control means 40 supplies power to the electric wire 512, a magnetic field is generated in the winding coil 503, and the driving shaft 505 is attracted/moved toward the upper case member 501. Since the driving shaft rapidly moves, ink 30 pushes up the ball check valve 508, and is discharged toward the outlet joint 509.

Subsequently, when the driving control means 40 stops its supply of power, the driving shaft 505 pushes the seal rubber 506 attached to the end surface thereof onto the mirror surface portion 504*a* by the spring 507, and stops. In this case, when a fluid resistance of the channel portion of the inlet joint 511 is higher than that of the gap 702, the ink 30 flows through the gap 702, and moves toward a center portion 505*a* of the driving shaft 505 (toward the ink outlet port 708). That is, the ink 30 is prevented from being pushed backward toward the ink inlet 706. Moreover, the ink outlet port 708 is also shielded by the ball check valve 508.

When such operation is repeated several times, one supply amount of the ink 30 is of the order of 10 to 80 microliters, but the ink can be supplied by the amount necessary for the ink jet head 100. Subsequently, the ink flows in a direction as shown by an arrow DR of FIG. 2, and is supplied to the ink jet head. Furthermore, since the driving shaft 505 can operate at a ratio of about 100 times/second, about 5 milliliters of ink 30 can be supplied in one second.

Additionally, a pressing force of the ball check valve 508 by the spring 510 is set to be lower than that of the ball check valve 508 by the driving shaft 505. Otherwise, the ink 30 cannot be supplied. In this case, closing seal properties are necessarily deteriorated. Then, the ink 30 probably flows backward. Therefore, in a standby state before ink supply, the driving shaft 505 needs to be driven toward the upper case member 501. However, in the present embodiment, since the seal rubber 506 satisfactorily shields the ink channel together with the mirror surface portion 504*a*, the ink is prevented from flowing backward. Therefore, even when the driving shaft 505 is stopped, the pressurizing state can be held.

EXAMPLE

The aforementioned embodiment will further concretely be described.

Figure 3:
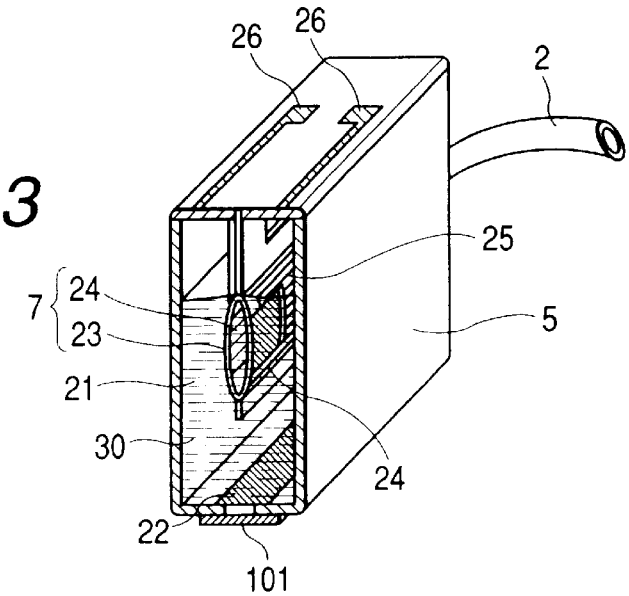
FIG. 3 is a schematic view showing a concrete example of an ink jet head shown in FIG. 1.

FIG. 3 is a partially cutaway view showing a concrete example of the ink jet head 100. As shown in FIG. 3, the ink jet head 100 is constituted of a substantially solid housing 5 prepared by injection-molding a polypropylene resin containing a glass fiber. An auxiliary ink storage 21 for storing the ink 30 is formed inside the housing 5, and ink jet discharge means 101 for ejecting the ink 30 is disposed in a bottom portion of the housing 5. The ink jet discharge means 101 is connected to the auxiliary ink storage 21 via a stainless steel filter 22. A type close to a type disclosed in Japanese Patent Application Laid-Open No. 9-254413 was used in the ink jet discharge means 101. Furthermore, in the housing 5 constituting the auxiliary ink storage 21, a connection joint 11 for connecting the auxiliary ink storage 21 to the liquid supplying pipe 2 of Teflon with an inner diameter of 1 mmϕ is disposed.

The ink residual amount detection means 7 for detecting the ink residual amount by the ink negative pressure is disposed in the auxiliary ink storage 21. As shown in FIGS. 1 and 3, the ink residual amount detection means 7 is constituted of a flexible bag 23, a pair of electrodes 24 disposed inside the bag 23, and an urging force generation spring 25 for generating a restoring force of the flexible bag 23, and the electrodes 24 are connected to the driving control means 40 via the electric signal conductors 26.

On the other hand, the ink tank bag 4 formed of flexible polypropylene and aluminum foil composite film was used in the ink storage means 20.

The liquid pressurizing supply apparatus of the present example will next be described in detail.

In FIG. 2, the upper and lower case members 501 and 502 also serving as the housing and magnetic flux path were manufactured by subjecting electromagnetic stainless steel mainly containing iron and chromium to a sheet metal drawing process. A material permeability is of the order of 6000 to 8000, and a material residual magnetic field is substantially 0. Used in the winding coil 503 was a coil copper wire coated with urethane, provided with a diameter of 50 to 100 μmϕ and manufactured by Hitachi Cable Ltd.

In the bobbin case 504, a polysulfone resin of such a grade that does not contain zinc stearate, tin stearate, lead, magnesium, or another additive adversely affecting the ink is used. The case was manufactured by injection molding. Particularly, the bottom surface on which the seal rubber 506 of the driving shaft 505 abuts is the mirror surface portion 504*a* inside the bobbin case 504. Therefore, a surface of an injection molding mold for molding the bottom surface was formed as a mirror surface. Additionally, after the bobbin case 504 is manufactured by injection molding, a satisfactory smooth member surface may be disposed on the bottom surface which abuts on the seal rubber 506 of the driving shaft 505. The aforementioned copper wire was wound around the bobbin case 504 manufactured a described above 1000 to 2000 times to form the winding coil 503.

The driving shaft 505 was manufactured of a nickel-based permalloy by cold forging. The permeability is about 80000, and is higher by one digit than that of the material of the upper and lower case members 501 and 502.

Thereafter, the fluorine-based seal rubber 506 was bonded to the driving shaft 505 by heat curing molding. For the spring 507, a stainless steel wire with a linear diameter of 0.2 mmϕ was used to foil a coiled spring. The respective members manufactured as described above were used to assemble the apparatus shown in FIG. 2 as follows.

First, a recessed drawn bottom surface of the lower case member 502 was spray-coated with an epoxy-based adhesive in a thickness of about 1 to 3 μm, and the bobbin case 504 with the winding coil 503 wound therearound was laid on the bottom surface of the lower case member. Considering a bonding force of the epoxy adhesive, in order to prevent the adhesive from being excessively squeezed in a horizontal direction of FIG. 2, a plurality of adhesive reservoirs 786 are disposed in the bonded surface of the bobbin case 504.

Subsequently, the driving shaft 505 and spring 507 were inserted into the bobbin case 504, and the upper case member 501 was assembled with the lower case member 502 via a packing 514 of chlorinated butyl rubber. Thereafter, the upper case member 501 was bonded to the lower case member 502 by arc spot welding.

Moreover, the ball check valve 508 was formed of fluorine-based rubber. In the upper case member 501, the outlet joint 509 formed of a polypropylene resin by injection molding was disposed. In the chamber formed by the upper case member and outlet joint 509, the ball check valve 508 was pressed by the stainless steel fixed spring 510 so as to close the ink outlet port 708. This outlet joint 509 was bonded to the upper case member 501 via the epoxy-based adhesive. Furthermore, an adhesive reservoir 886 was disposed in the bonded surface of the outlet joint 509 in order to enhance the bonding force, and prevent excessive adhesive from being squeezed out.

Subsequently, the outlet joint 509 was connected to the Teflon liquid supplying pipe 2, and the pipe was connected to the connection joint 11 of the ink jet head 100. The inlet joint 511 integrally molded with the bobbin case 504 was connected to the polypropylene tank joint 515 via an adhesive 889, and the tank joint was connected to the ink storage means 20.

Moreover, the winding coil 503 was electrically connected to the driving control means 40 of the liquid pressurizing supply apparatus via the lead terminal 513 and electric wire 512.

Subsequently, the ink storage bag 4 was filled with the ink 30, the auxiliary ink storage 21 of the ink jet head 100 was also filled with the ink 30, and the pipe 2 was further filled with the ink 30. As the ink jet discharge means 101 ejected and consumed the ink, the ink 30 in the auxiliary ink storage 21 was reduced, and the flexible bag 23 of the ink residual amount detection means 7 bulged. As a result, in a certain ink consumption stage, the electrode 24 was detached, electricity was disconnected, and it was detected that the auxiliary ink storage 21 required the ink 30. In response to this signal, the driving control means 40 supplied a sinusoidal wave pulse current of ±8 V, 0.05 A, 10 Hz to the liquid pressurizing supply apparatus 10. Through this current, the winding coil 503 generated or extinguished the magnetic field, the driving shaft 505 was attracted to or detached from the upper case member 501, and therefore the ink 30 could be supplied toward the ink jet head 100. As the ink 30 was accumulated in the auxiliary ink storage 21, the flexible bag 23 was contracted, and the electrode 24 was connected. Then, the ink residual amount detection means 7 detected that the supply of the ink 30 became unnecessary. As a result, the supply of the current was stopped, and the supply of the ink 30 from the liquid pressurizing supply apparatus 10 was stopped. subsequently, a recovering operation of the ink jet head 100 was performed. In this method, even after the ink residual amount detection means 7 detected that the ink became unnecessary, the pulse current was further continuously supplied for 10 seconds. As a result, the supply amount of the ink 30 exceeded the amount necessary for the ink jet head 100, and the excessive ink 30 therefore began to leak via the ink discharge orifice of the ink discharge means 101 of the ink jet head 100, and then began to be inertially ejected. In this state, the surface of the ink discharge means 101 with the ink discharge orifice formed therein was cleaned with a rubber wiper. Since the surface is cleaned with the wiper in the ejected state of the ink 30, the problem that the dust and foreign particle are pushed into the ink discharge orifice is not caused.

Thereafter, a constant amount of ink was ejected, and the auxiliary ink storage 21 in the ink jet head 100 was brought to a slight negative pressure state. In this state, excess ink did not leak during ink jet discharge. When such mechanism is mounted on an ink jet printer, an image can satisfactorily be recorded, and the ink jet head can satisfactorily be recovered and cleaned.

Second Embodiment

Figure 4:
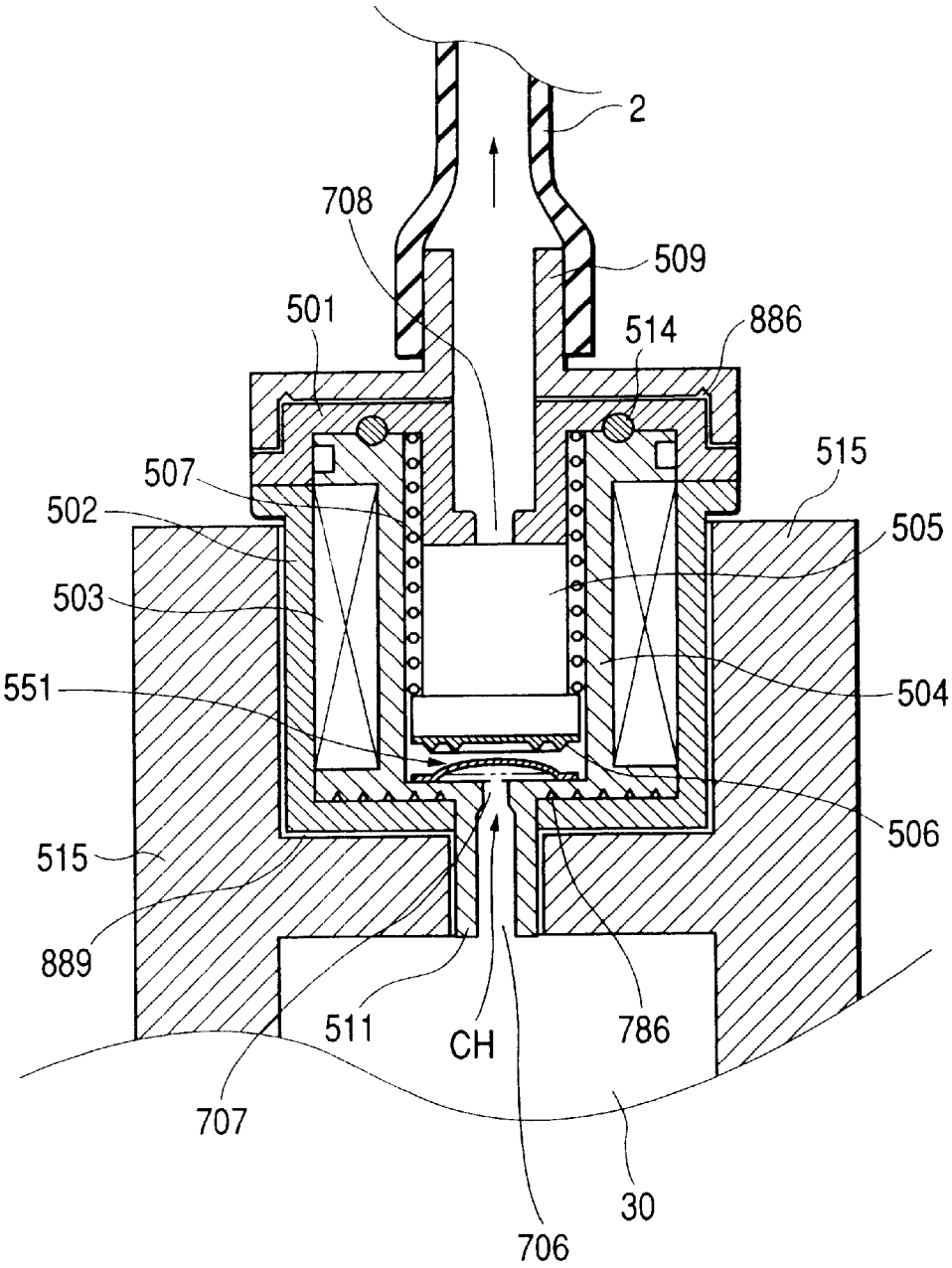
FIG. 4 is a schematic sectional view showing a state in which the liquid pressurizing supply apparatus of a second embodiment of the present invention supplies liquid.

FIG. 4 is a schematic sectional view showing a state in which the liquid pressurizing supply apparatus of a second embodiment of the present invention supplies liquid. Instead of the ball check valve (denoted with reference numeral 506 in FIG. 2) of the liquid pressurizing supply apparatus according to the first embodiment, a film check valve 551 may be disposed in the ink inlet port 707. In this case, the ball check valve and fixed spring (denoted with 510 in FIG. 2) can be omitted, and the outlet joint 509 can also be omitted if necessary, so that the structure can be simplified. A constitution and action different from those of the first embodiment will mainly be described hereinafter.

Figure 5A:
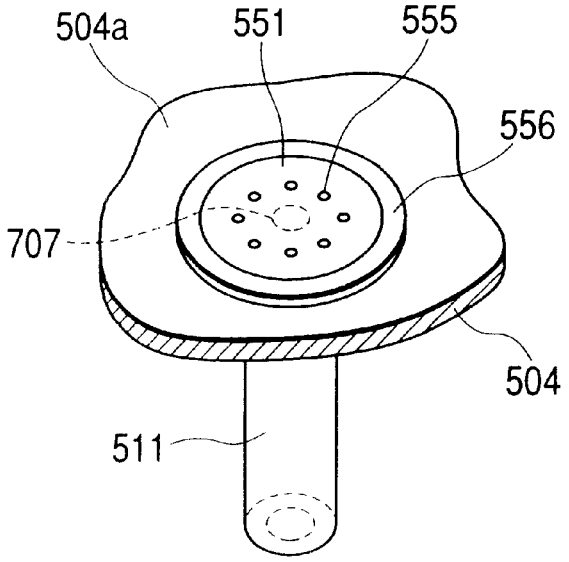
FIGS. 5A and 5B are schematic perspective views showing a constitution example of a film check valve and a peripheral portion of the valve shown in FIG. 4.
Figure 5B:
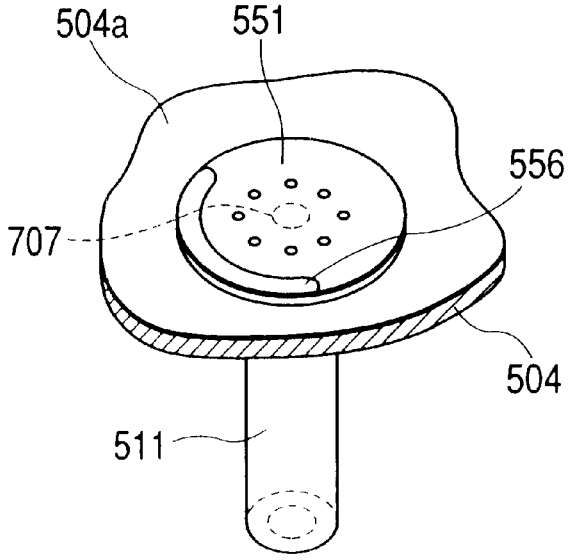

FIGS. 5A and 5B show constitution examples of the film check valve 551 and a peripheral portion of the valve. As shown in FIGS. 5A and 5B, the film check valve 551 is welded/fixed to the mirror surface portion 504*a* of the bobbin case 504 via a heat welded portion 556 so as to cover the ink inlet port 707. For example, the film check valve 551 is formed of a thin polypropylene film. As shown in FIG. 5A, an entire outer peripheral edge of the valve is welded/fixed via the heat welded portion 556, and a small ink flow hole 555 is formed in a peripheral portion of the valve remote from a portion disposed opposite to the ink inlet port 707. Moreover, instead of this constitution, as shown in FIG. 5B, only a part of the outer peripheral edge of the film check valve 551 covering the ink inlet port 707 may be welded/fixed via the heat welded portion 556.

According to the aforementioned embodiment shown in FIGS. 4 and 5A and 5B, when the driving shaft 505 is attracted and moved toward the upper case member 501 by the electromagnetic force, the ink 30 flows out to the outlet joint 509, and the film check valve 551 is momentarily pulled upward. Furthermore, when the film check valve 551 is constituted as shown in FIG. 5A, the ink 30 is passed through the ink flow hole 555 from the ink inlet port 707, and supplied into the chamber in which the driving shaft 505 is disposed. As a result, the ink flows toward the ink inlet port 707 from the ink inlet 706.

Thereafter, when the driving shaft 505 stops, and the ink 30 stops flowing, the film check valve 551 is brought to a state "CH" by its elasticity as shown by a two-dot chain line in FIG. 4 to shield the ink channel from the ink inlet port 707. Thereby, even when the driving shaft 505 is pressed onto the mirror surface portion 504*a* of the bobbin case 504 by the urging force of the spring 507, the ink 30 does not flow backward. The ink turns around the driving shaft 505 and moves toward the ink outlet port 708.

When this operation is continuously repeated a plurality of times, flow, and pressure exerted in a flow direction are generated in the ink 30. The ink can be supplied without applying any ink discharge pressure to the ink storage means. Moreover, even when the negative pressure for drawing the ink into the ink storage means is generated, the ink can be supplied by generating a pressure which surpasses the negative pressure.

Moreover, when the aforementioned operation is repeated a plurality of times, the ink 30 enters the liquid pressurizing supply apparatus of the present invention via the ink inlet port 707 from the ink inlet 706, and is supplied toward the ink jet head 100 via the liquid supplying pipe 2 from the outlet joint 509. When a triangular wave signal of ±8 V, 0.06 A, 20 Hz was supplied to the winding coil 503 of the liquid pressurizing supply apparatus, the ink was supplied at a ratio of about 0.8 ml/second.

Additionally, as shown in FIG. 5B, only a part of the film check valve 551 may be fixed to the mirror surface portion 504*a*. This is preferable in respect of the manufacturing cost. However, in this form, a returning operation is slow, operation follow-up properties can be obtained only up to 3 Hz, and the supply amount of the ink 30 is possibly remarkably reduced. However, it can be supposed that little higher signal follow-up properties are obtained and the supply ability of the ink 30 is improved by considering and studying various materials of the film check valve 551. In this case, instead of the polypropylene film, a stretched polypropylene film, polyimide film, fluorine rubber film with a high hardness, or another material may be used in the film check valve 551.

Third Embodiment

Figure 6:
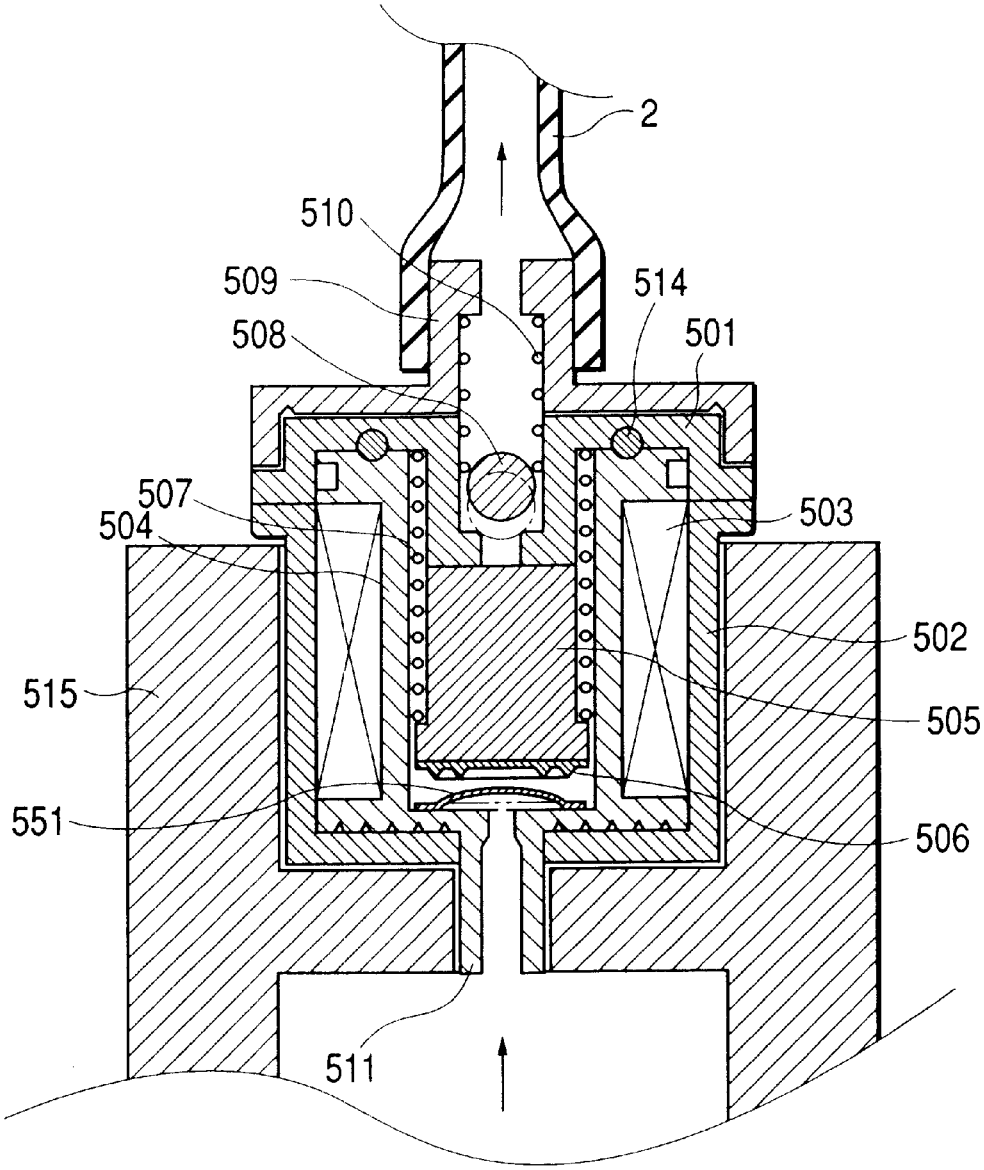
FIG. 6 is a schematic sectional view showing a state in which the liquid pressurizing supply apparatus of a third embodiment of the present invention supplies liquid.

FIG. 6 is a schematic sectional view showing a state in which the liquid pressurizing supply apparatus of a third embodiment of the present invention supplies liquid. As in the embodiment shown in FIG. 6, both the ball check valve 508 of the first embodiment and the film check valve 551 of the second embodiment may be used. An effect different from effects of the first and second embodiments will mainly be described. Since the constitution is the same as the constitutions of the first and second embodiments, description thereof is omitted.

In the present embodiment, as compared with the first or second embodiment, shielding properties are enhanced, resistance of the flow direction of the ink 30 can be brought in one direction, back flow can be prevented, and supply efficiency of the ink 30 can be enhanced.

As a result, the ink 30 can be supplied even with the driving distance of the driving shaft 505 of about 0.1 to 0.2 mm. Since the driving distance is set to about 0.1 mm, the material of the driving shaft can be low-permeability inexpensive electromagnetic stainless steel. The permeability of about 6000 to 8000 is realized by an iron-chromium based electromagnetic stainless steel, and driving voltage can also be set to ±3 V, 0.05 A. The driving electric signal is not limited to ±3 V, and a DC pulse signal of 0 to 6 V may be used. That is, a current amount is important, the magnetic field generated by the current drives the driving shaft 505. However, a current value and voltage value are important for power consumption. if the power consumption increases, an ink jet printer-main body power capacity needs to be raised. Therefore, the liquid pressurizing supply apparatus is preferably constituted such that the power consumption is as low as possible. In this case, the ink supply amount per one operation is reduced, but frequency follow-up properties are enhanced, and about 250 Hz can be followed up. In this vicinity, noise increases. Therefore, the operation with 20 Hz or less is preferable. Even with 20 Hz, the ink supply is possible at a ratio of 0.3 ml/second. This power is sufficient when considering from the ink use amount of the ink jet head 100.

Fourth Embodiment

Figure 7:
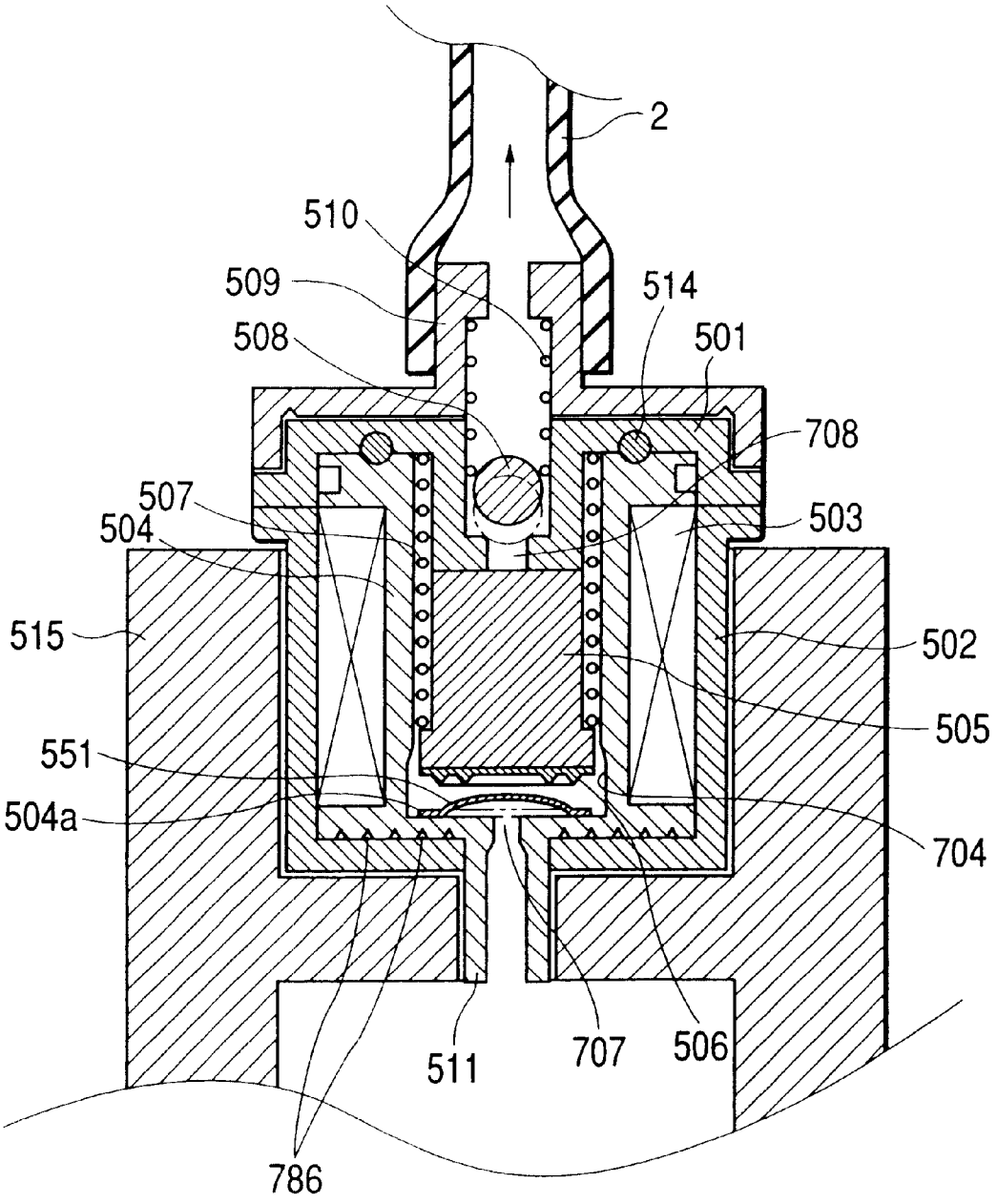
FIG. 7 is a schematic sectional view showing a state in which the liquid pressurizing supply apparatus of a fourth embodiment of the present invention supplies liquid.

FIG. 7 is a schematic sectional view showing a state in which the liquid pressurizing supply apparatus of a fourth embodiment of the present invention supplies liquid.

As in the embodiment shown in FIG. 7, in the bobbin case 504 described in the aforementioned embodiments, an inclined taper portion 704 for enlarging an inner diameter of the vicinity of the mirror surface portion 504*a* is preferably formed in the chamber in which the driving shaft 505 is disposed. In this case, an ink flow-in resistance to the chamber in which the driving shaft 505 is disposed decreases, and supply efficiency of the ink 30 by the driving shaft 505 can be raised.

In this form, particularly when one check valve is used as shown in FIG. 2 or 4, the effect is large. For example, when the taper portion 704 is formed in the chamber having a pulse frequency of 20 Hz and ink supply amount of 1 ml/second, the supply efficiency increases to about 1.5 ml/second. The taper portion is formed after forming the bobbin case 504, and cutting/working an inside portion of the bobbin case.

Furthermore, this effect is remarkably obtained even with the short driving distance of the driving shaft 505.

The liquid pressurizing supply apparatus was mounted on each mechanism for each color ink supply, and a four-color ink jet printer was experimentally produced. As a result, in response to the signal of the ink residual amount detection means 7 by the ink consumption of the ink jet head 100 shown in FIG. 1, each color ink 30 could satisfactorily be supplied, and the image could satisfactorily be printed. Moreover, after a certain number of sheets were printed, the ink jet head 100 was recovered and cleaned. In this case, it was possible to clean and recover the head while ejecting the ink 30 from the present liquid pressurizing supply apparatus via the ink discharge orifice of the ink jet head 100. Moreover, for the ink pressure of the ink storage means, when the ink storage bag is used, and the ink is consumed, the negative pressure is generated by contraction resistance of the ink storage bag, and a maximum value is a head pressure of about −60 mm aq. When the container open to the atmosphere is used, the ink pressure depends on a height difference between the container and the ink jet head, but the ink can be supplied even with a head-pressure minimum value of −1000 mm aq (the ink storage means is positioned below the ink jet head by about 40 cm).

Fifth Embodiment

Figure 8:
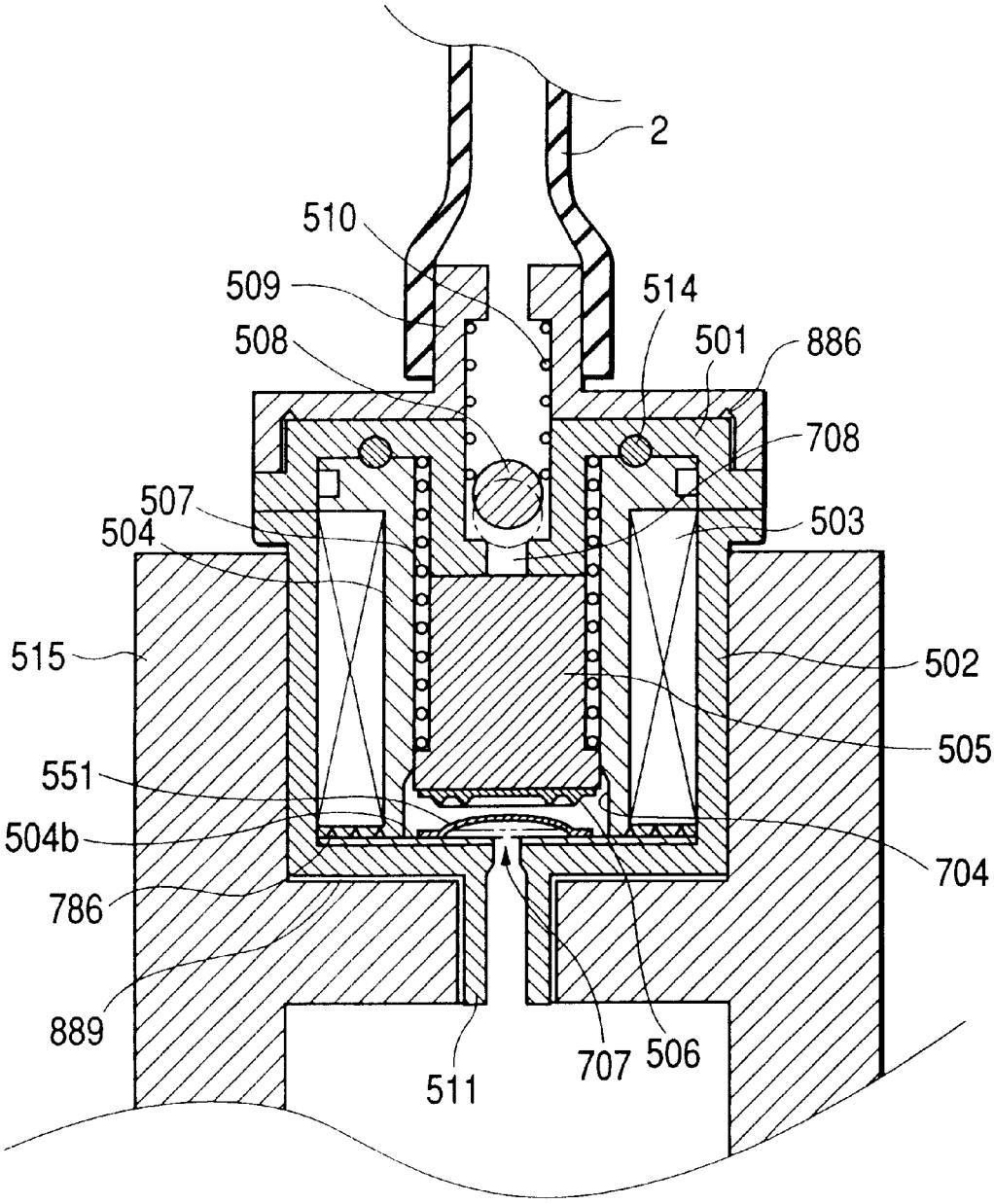
FIG. 8 is a schematic sectional view showing a state in which the liquid pressurizing supply apparatus of a fifth embodiment of the present invention supplies liquid.
Figure 9A:
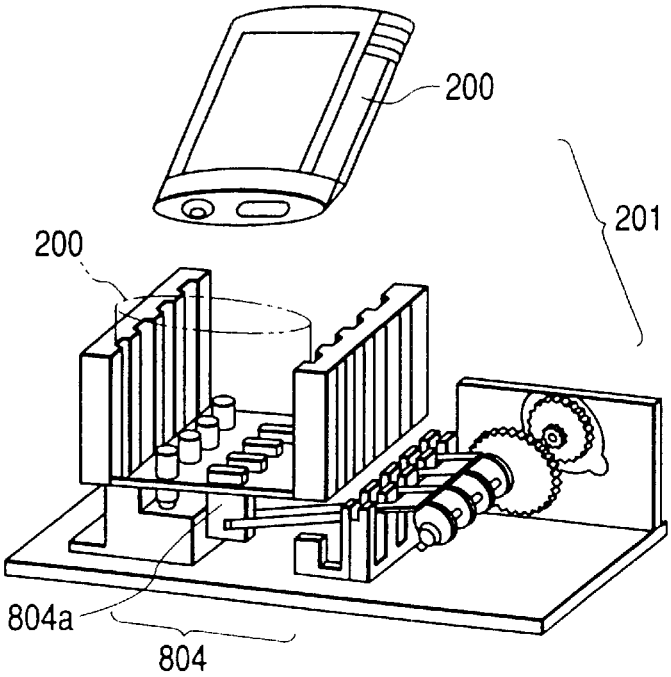
FIG. 9A (PRIOR ART)
FIGS. 9A and 9B are views showing a liquid tank and liquid supply mechanism for use in a conventional liquid pressurizing supply system.
Figure 9B:
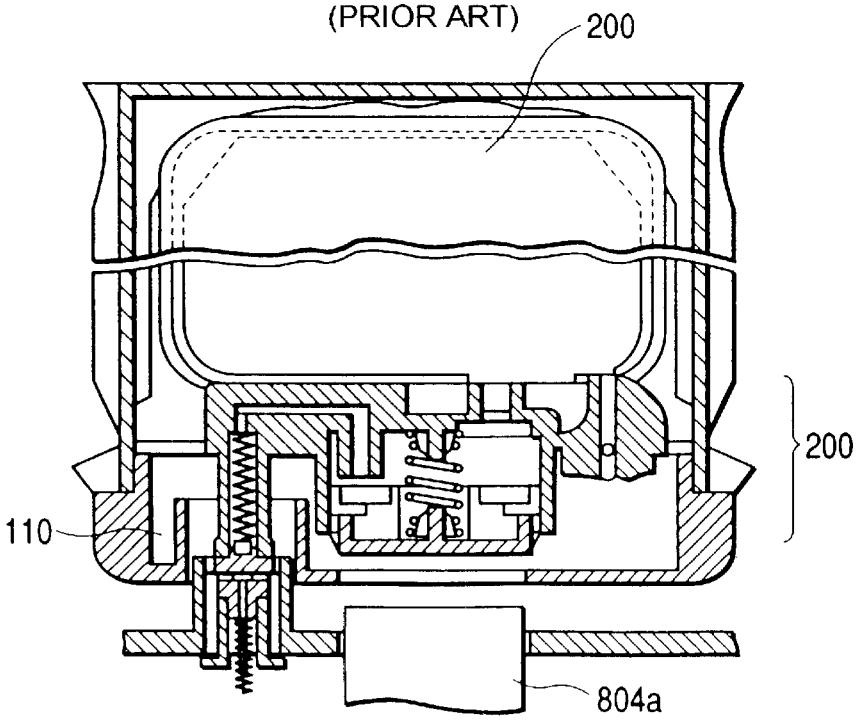
FIG. 9B (PRIOR ART)

FIG. 8 is a schematic sectional view showing a state in which the liquid pressurizing supply apparatus of a fifth embodiment of the present invention supplies liquid.

As in the embodiment shown in FIG. 8, the surface which abuts on the seal rubber 506 of the driving shaft 505 may be constituted by a smooth surface portion 504*b* instead of a part of the bobbin case 504 of the aforementioned respective embodiments. The smooth surface portion is a recessed bottom surface of the lower case member 502 formed by a deep drawing process, and this recessed bottom surface is coated with a resin.

In this embodiment, a scratch or an irregularity of the surface of the lower case member 502 as the housing, which has been made in the deep drawing process, is covered with the resin to be flat. Therefore, the ink channel can securely be shielded by this coated and recessed surface which abuts on the seal rubber 506 of the driving shaft 505, in the same manner as the mirror surface integrally formed with the bobbin case 504 by injection molding. Moreover, this form of the surface can appropriately be applied to the aforementioned respective embodiments.

As described above, since the bottom surface portion of the bobbin case is used as the seal surface of the driving shaft, the surface having many scratches formed by the drawing process with the metal mold, and being difficult to be smoothed can be used in a state close to the state of the smooth mirror surface. This enables the ink supply even in the small driving area of the small-sized actuator.

Furthermore, since a plurality of check valves are disposed, the ink supply stability is further enhanced even in the small driving-shaft driving area. Additionally, since the inclined taper portion is formed on the inner surface of the bobbin case, the ink supply efficiency is further enhanced. This can realize the small-sized low-consumption ink supply apparatus with an occupying volume of about 8 $cm^3$ or less, a diameter of about 12 mm or less, power consumption of about 1.5 W or less, and driving voltage of 20 V or less.

As described above, according to the liquid pressurizing supply apparatus of the present invention, the ink supply system can be simplified in constitution and reduced in size without disposing any complicated ink pushing apparatus or any pressurizing discharge apparatus in or after the ink storage means. Furthermore, the power consumption can remarkably be reduced.

Moreover, the ink jet head can be cleaned or recovered while ejecting the ink via the ink discharge orifice, and satisfactory cleaning is realized. Furthermore, since the liquid pressurizing supply apparatus can be miniaturized, such ink supply and recovery mechanism can be mounted on each color mechanism of the ink jet printer. Additionally, the ink jet printer itself can also be reduced in size and weight.

What is claimed is:

1. A liquid pressurizing supply apparatus driven in response to an alternating or pulse electric signal, comprising:

a high-permeability driving shaft;

urging force generation means for urging the driving shaft in one direction;

a bobbin case in which the driving shaft is disposed in a cylindrical chamber;

a winding coil wound around an outer peripheral surface of the bobbin case;

a pair of high-permeability case members in which said bobbin case with the winding coil wound therearound is contained, and a containing recess portion is formed by a sheet metal drawing process;

a channel portion connected to the cylindrical chamber of said bobbin case in which said driving shaft is disposed; and at least one back-flow prevention means for preventing back-flow, wherein a portion onto which said driving shaft is pressed by said urging force generation means is a molded smooth surface integrally molded with said bobbin case, a portion of said driving shaft bonded to the molded smooth surface is provided with a seal rubber, and said channel portion is shielded by said molded smooth surface and said seal rubber.

2. The liquid pressurizing supply apparatus according to claim 1 wherein said back-flow prevention means comprises one or both of a ball check valve and a film check valve.

3. The liquid pressurizing supply apparatus according to claim 2 wherein an inclined taper portion for enlarging an inner diameter of a vicinity of a portion onto which said driving shaft is pressed by said urging force generation means of the cylindrical chamber is formed in t he cylindrical chamber of said bobbin case.

4. The liquid pressurizing supply apparatus according to claim 3 wherein a volume of the apparatus is 8 $cm^3$ or less.

5. The liquid pressurizing supply apparatus according to claim 4 wherein a moving distance of said driving shaft is in a range of 0.1 to 0.8 mm.

6. The liquid pressurizing supply apparatus according to claim 5 wherein a power of the electric signal is in a range of 0.2 to 1.5 W.

7. The liquid pressurizing supply apparatus according to claim 1 wherein a portion onto which said driving shaft is pressed by said urging force generation means is a coated smooth surface formed on a bottom surface of said containing recess portion of said one high-permeability case member, a portion of said driving shaft bonded to the coated smooth surface is provided with a seal rubber, and said channel portion is shielded by said coated smooth surface and said seal rubber.

8. The liquid pressurizing supply apparatus according to claim 7 wherein said back-flow prevention means comprises one or both of a ball check valve and a film check valve.

9. The liquid pressurizing supply apparatus according to claim 8 wherein an inclined taper portion for enlarging an inner diameter of a vicinity of a portion onto which said driving shaft is pressed by said urging force generation means of the cylindrical chamber is formed in the cylindrical chamber of said bobbin case.

10. The liquid pressurizing supply apparatus according to claim 9 wherein a volume of the apparatus is 8 $cm^3$ or less.

11. The liquid pressurizing supply apparatus according to claim 10 wherein a moving distance of said driving shaft is in a range of 0.1 to 0.8 mm.

12. The liquid pressurizing supply apparatus according to claim 11 wherein a power of the electric signal is in a range of 0.2 to 1.5 W.

13. A liquid discharge recording apparatus comprising: a liquid discharge head for ejecting a liquid droplet to record an image; liquid residual amount detection means; liquid storage means; a liquid supplying pipe for supplying a liquid of said liquid storage means to said liquid discharge head; the liquid pressurizing supply apparatus according to claims 1 to 12; and driving control means of the liquid pressurizing supply apparatus, wherein said liquid pressurizing supply apparatus is disposed midway in said liquid supplying pipe or in a liquid guide outlet of said liquid storage means, and said driving control means allows said liquid pressurizing supply apparatus to supply the liquid in a pressurized state during cleaning/recovering of said liquid discharge head so that the liquid is ejected via a discharge orifice of said liquid discharge head.

14. The liquid discharge recording apparatus according to claim 13 wherein said liquid storage means is in a normal pressure state, a 0-pressure state, or a negative pressure state of a head pressure of 0 to 1000 mm aq.

15. The liquid discharge recording apparatus according to claim 14 wherein said liquid discharge recording apparatus is mounted on each color system.

* * * * *

UNITED STATES PATENT AND TRADEMARK OFFICE

CERTIFICATE OF CORRECTION

PATENT NO. : 6,431,693 B2
DATED : August 13, 2002
INVENTOR(S) : Masataka Eida

It is certified that error appears in the above-identified patent and that said Letters Patent is hereby corrected as shown below:

Column 2,
Line 18, “detail” should read -- detailed --.

Column 4,
Line 41, “can” should read -- can be --; and
Line 65, “above mentioned a” should read -- the above-mentioned --.

Column 8,
Line 50, “a” should read -- as --.

Column 9,
Line 59, “subsequently,” should read -- ¶ Subsequently, --.

Signed and Sealed this

Fourth Day of February, 2003

JAMES E. ROGAN
*Director of the United States Patent and Trademark Office*